United States Patent [19]

Morris

[11] 4,241,892

[45] Dec. 30, 1980

[54] APPLIANCE SKIDBOARD AND METHOD OF MAKING

[75] Inventor: Ivan B. Morris, Louisville, Ky.

[73] Assignee: Boone Box Co., Louisville, Ky.

[21] Appl. No.: 71,139

[22] Filed: Aug. 31, 1979

[51] Int. Cl.[3] ..... B65D 19/00

[52] U.S. Cl. ..... 248/346; 108/51.1; 156/253; 206/320

[58] Field of Search ..... 248/346; 108/51.1, 51.3, 108/53.1-53.5, 55.1-57.1; 206/320, 386, 599, 600; 156/253; 93/1 A, 1 H

[56] References Cited

U.S. PATENT DOCUMENTS

| | | | |
|---|---|---|---|
| 2,388,730 | 11/1945 | Fallert | 108/51.3 |
| 3,080,690 | 3/1963 | Budd | 108/51.3 X |
| 3,648,959 | 3/1972 | Wagner | 248/346 |
| 3,907,241 | 9/1975 | Oglesby et al. | 108/51.3 |
| 4,119,451 | 10/1978 | Fujii | 156/253 X |

*Primary Examiner*—William E. Lyddane

*Attorney, Agent, or Firm*—Kane, Dalsimer, Kane, Sullivan and Kurucz

[57] ABSTRACT

This disclosure is of a skidboard to be affixed to appliances for cushioned support, which skidboard comprises a corrugated board core having top and bottom facing sheets affixed to the core with holes drilled through the sheets and core to receive bolts to affix the skidboard to the appliance, the board core being depressed for a portion of its depth around the holes to provide solid bases and stable cushions for the heads and washers of the bolts to be screwed through the skidboard into the base of the appliance.

This disclosure also includes the method of making such skidboard to provide the bases and cushions in the board.

5 Claims, 7 Drawing Figures

APPLIANCE SKIDBOARD AND METHOD OF MAKING

BACKGROUND OF THE INVENTION

1. Field of the Invention

The invention relates to skidboards and more particularly to an improved skidboard which is affixed to refrigerators and similar appliances which require a cushioned support and to the method of making such skidboard.

2. Brief Description of the Prior Art

The skidboard in use prior to the skidboard of the present invention was formed of strips of wood separated by styrofoam spacers. Such skidboard, when assembled to the bottom of the refrigerator and put on a vibration test over a period of time, disintegrated, indicating that in some rail shipments trouble occurred from the vibration. The skidboard of the present invention with corrugated spacers held up perfectly in a similar vibration test and did not disintegrate.

The prior skidboard required heavier wood strips which resulted in a skidboard more than twice as heavy as the skidboard of the present invention. This is an obvious saving in freight costs and an advantage to the people handling the skidboards on the line.

The overall appearance of the skidboard of the present invention is noticeably better than the prior skidboard.

The safety feature of the skidboard of the present invention has been decidedly improved. The old skidboard was put together with nails that sometimes protruded and caused accidents to the people on the line. Also, the foam required workers to wear goggles as parts of the foam would fly in the air and be an irritation to the skin and a danger to the eyes. It also gave an undesirable odor.

The customer was unable to carry an inventory of the old skidboard due to the fact that it was made with green lumber and would warp severely after two or three days. To get around this they carried a one day inventory and got them assembled before warpage occurred. With the present skidboard, this would not be a problem.

The prior skidboard under a flat crush test completely collapsed at 2,900 pounds. The present skidboard takes over 14,000 pounds before crushing.

It will thus be apparent that the present skidboard has definite advantages over the prior skidboard.

SUMMARY OF THE INVENTION

The invention comprises a skidboard to be affixed to and support an appliance which skidboard comprises:

a core of built-up glued corrugated board of uniform thickness with the flutes running normal to the top and bottom of the core;

top and bottom facing sheets affixed to the top and bottom edges of the core;

first holes drilled through the said sheets and core to receive bolts to affix the skidboard to the base of the appliance;

second holes larger than the first holes drilled through the bottom sheet to create areas around the first holes;

the board of the core above the said areas being matted and compressed for a portion of the depth to create solid bases and stable cushions for the heads and washers of the bolts to be screwed through the skidboard into the base of the appliance.

The invention further comprises a method for making such skidboards which method comprises:

affixing top and bottom facing sheets to the top and bottom edges of a core of built-up glued corrugated board of uniform thickness with the flutes running normal to the said facing sheets;

drilling first holes through the said sheets and core to receive bolts to affix the skidboard to the base of the appliance;

drilling second holes larger than the first holes through the bottom sheet to create areas around the first holes;

counter punching the board of the core above the said areas while the glue adhering the sheets of corrugated board together is in a wet condition to depress the board for a portion of its depth; whereby the board around the first holes is matted and compressed when the glue dries and hardens to create solid bases and stable cushions for the heads and washers of the bolts to be screwed through the skidboard into the base of the appliance.

DETAILED DESCRIPTION

Figure 1:
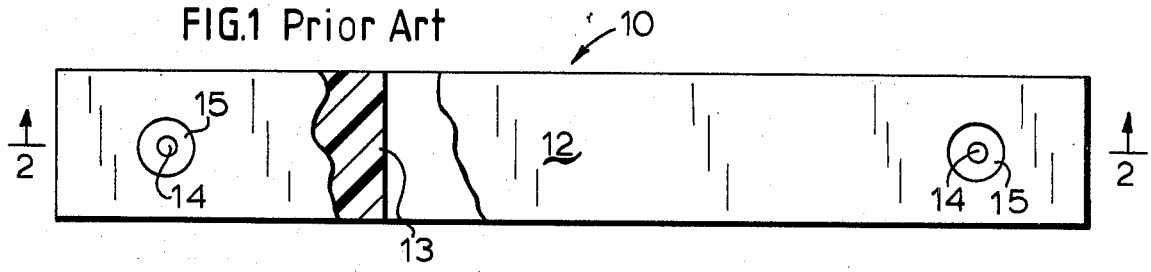
FIG.1 Prior Art
FIG. 1 is a top plan view of the prior skidboard.
Figure 2:
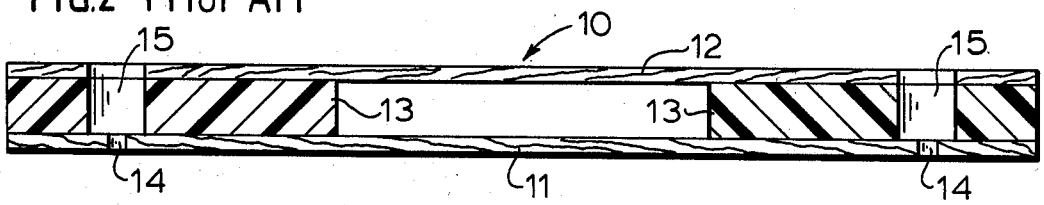
FIG.2 Prior Art
FIG. 2 is a side view of the skidboard of FIG. 1.

Referring to the drawings there is shown in FIGS. 1 and 2 and skidboard 10 heretofore in use. Such skidboard is formed of top and bottom wooden strips 11 and 12 separated by styrofoam spacers 13. Although the dimensions are subject to variation for particular needs, the thickness of the top strip is 5/8" and of the bottom strip 3/8". The skidboard is drilled through the strips and styrofoam to provide holes 14 to receive bolts to affix the skidboard to the base of an appliance. The bottom strip 12 and the styrofoam are counter drilled to provide larger holes 15 around the holes 14. The larger holes permit bolts to be inserted through the holes 14 with the heads and washers of the bolts resting directly against the inside of the wooden strip 11. There is no cushioning between such heads and washers and the top wooden strip. The disadvantages of the prior skidboard have been heretofore pointed out.

Figure 3:
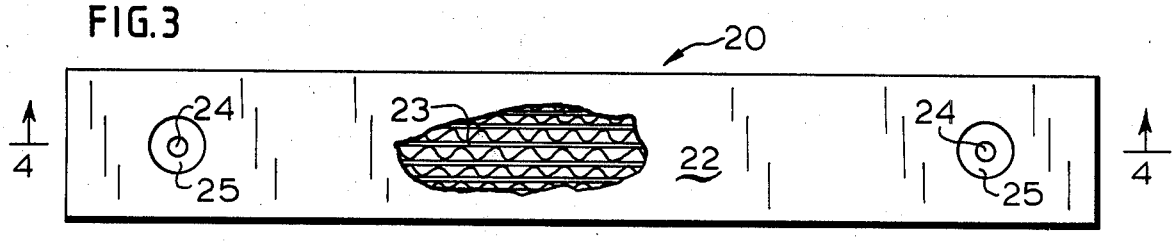
FIG. 3 is a top plan view of the skidboard of the present invention.
Figure 4:
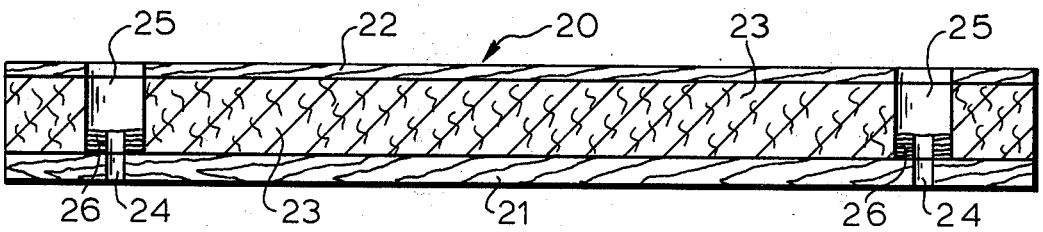
FIG. 4 is a side view of the skidboard of FIG. 3.
Figure 5:
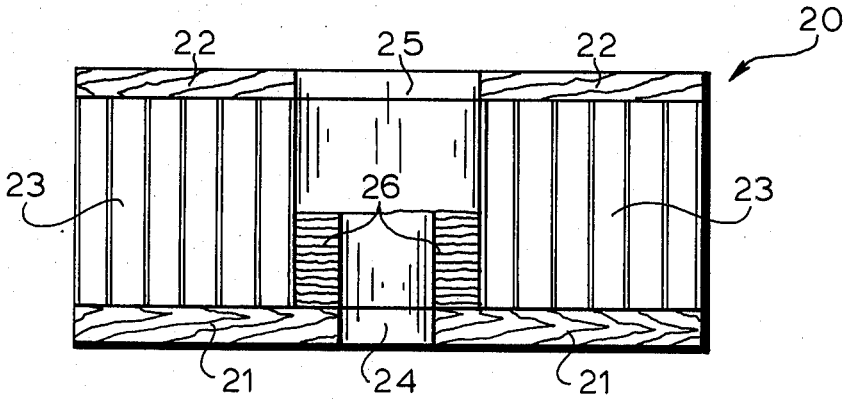
FIG. 5 is a sectional view along the line 5—5 of FIG. 4.

The skidboard 20 of the present invention is illustrated in FIGS. 3, 4 and 5. The skidboard is formed of top and bottom sheets 21 and 22 adhered to a core 23 of built-up glued corrugated board of uniform thickness with the flutes running normal to the top and bottom sheets. Although various types of paper or board can be used for the core, it has been found that 26 lb. kraft with a 26 lb. semi-chemical medium gives an ideal core. This combination of material showed a compression test from top to bottom of 10,000 lbs. or more. As herein used the term "built-up glued corrugated board" applies to and includes honeycomb formed of paper or board where the sheets are built up with alternate staggered parallel lines of adhesive which when expanded will provide a cellular material similar to corrugated board.

The top and bottom sheets 21 and 22 of the skidboard are preferably formed of a wood veneer with the top sheet thicker than the bottom sheet. Although a bottom sheet $\frac{1}{8}''$ in thickness and a top sheet $\frac{1}{4}''$ in thickness has been found satisfactory in use and tests, it will be understood that such thickness can be varied to suit particular needs. Other material may be used for such sheets, for example, pressed board, hardboard, plastic and the like.

Figure 6:
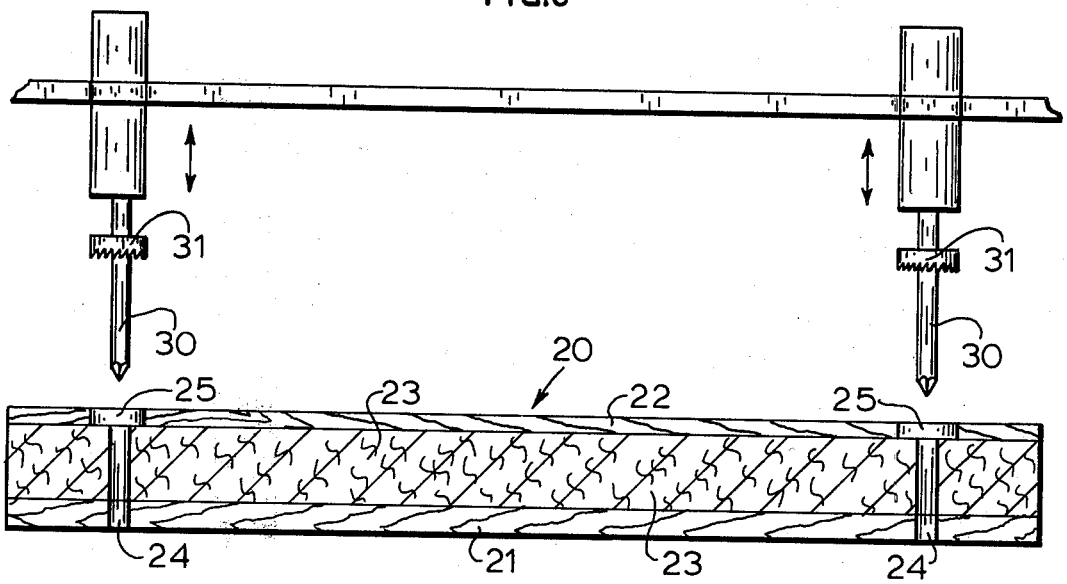
FIG. 6 is a side view of the skidboard and the drills for drilling a hole through the skidboard and bottom sheet of the skidboard.
Figure 7:
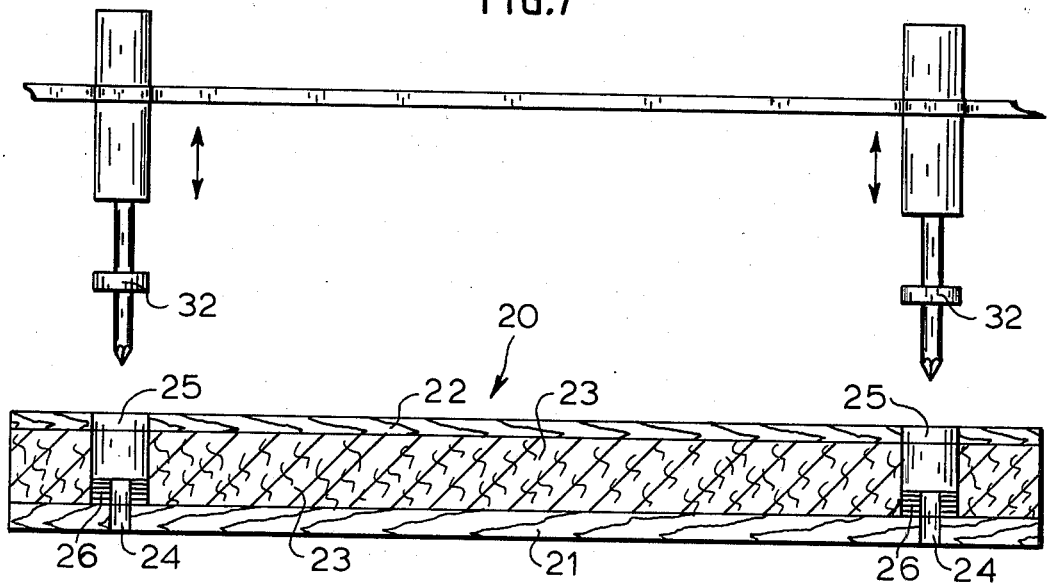
FIG. 7 is a side view of the skidboard and the punch for depressing the board of the core for a portion of its depth.

The skidboard is first drilled by drills 30 (FIG. 6) with holes 24 that go through the top and bottom sheets and the core. Such holes are adapted to receive a bolt which is screwed into the base of the appliance to hold the skidboard to the appliance. As an example the hole can be $\frac{1}{2}''$ in diameter. The holes are positioned to align with the threaded holes in the bottom of the appliance. Each hole serves as a guide for a counter bore 31 which drills a second hole 25 only through the bottom sheet and around the first bolt hole. The diameter of the second hole is determined by the size of the tool that they use to drive the bolt up into the base of the appliance. For example such second hole can be $1\frac{3}{8}''$ in diameter. A counter punch 32 is then inserted into the second hole and the board of the core is depressed for a portion of its depth to provide a solid base and stable cushion 26 for the head and washer of the bolt to be screwed through the skidboard into the base of the appliance. The counter punch is applied against the core at the time when the glue adhering the sheets of corrugated board together is still in a wet condition. After the core is thus pressured together and the glue then hardens it makes a firm solid base of the washer and bolt to be used. The board is just torn by the punch and depressed but it makes a nice round hole. As an example the board base and cushion can be $\frac{1}{2}''$ against the top sheet. It has been found that, if the head and washer of the bolt rests directly on the top sheet the veneer would under a drop test tear away from the core and leave nothing attached to the appliance but the piece of wood veneer. On the other hand, with the solid matted board against the top sheet such top sheet does not tear the skidboard from the appliance under a drop test.

Although the drilling, counter boring and counter punching has been described for the hole and base for one bolt, it will be understood that multiple drills, counter bores and counter punches can be used to form a complete skidboard or a plurality of skidboards. A large core faced with sheets can be drilled, counter bored and counter punched and then cut into separate skidboard.

What is claimed:

1. A skidboard to be affixed to and support an appliance comprising:

a core of built-up glued corrugated board of uniform thickness with the flutes running normal to the top and bottom of the core;

top and bottom facing sheets affixed to the top and bottom edges of the core;

first holes drilled through the said sheets and core to receive bolts to affix the skidboard to the base of the appliance;

second holes larger than the first holes drilled through the bottom sheet to create areas around the first holes;

the board of the core above the said areas being matted and compressed for a portion of the depth of the core to create solid bases and stable cushions for the heads and washers of the bolts to be screwed through the skidboard into the base of the appliance.

2. The skidboard of claim 1 in which the top and bottom facing sheets are made of wood veneer.

3. The skidboard of claim 1 in which the top and bottom facing sheets are made of pressed board.

4. The skidboard of claim 1 in which the top and bottom of facing sheets are made of hardboard.

5. The method of making a skidboard to be affixed to and support an appliance having a corrugated board core with top and bottom facing sheets, holes drilled through the core and sheets to receive bolts to affix the skidboard to the base of the appliance and solid bases and stable cushions in the core around the holes for the heads and washers of the bolts comprising:

affixing top and bottom facing sheets to the top and bottom edges of a core of built-up corrugated board of uniform thickness with the flutes running normal to the said facing sheets;

drilling first holes through the said sheets and core to receive bolts to affix the skidboard to the base of the appliance;

drilling second holes larger than the first holes through the bottom sheet to create areas around the first holes;

counter punching the board of the core above the said areas while the glue adhering the sheets of corrugated board together is in a wet condition to depress the board for a portion of its depth;

whereby the board around the first holes is matted and compressed when the glue dries and hardens to create solid bases and stable cushions for the heads and washers of the bolts to be screwed through the skidboard into the base of the appliance.

* * * * *